US006238257B1

(12) United States Patent
Platzer et al.

(10) Patent No.: US 6,238,257 B1
(45) Date of Patent: May 29, 2001

(54) SURFACE VESSEL WITH A WATERJET PROPULSION SYSTEM

(75) Inventors: Gregory P. Platzer, Wrentham; Francesco Lanni, Walpole, both of MA (US)

(73) Assignee: Bird-Johnson Company, Walpole, MA (US)

( * ) Notice: Subject to any disclaimer, the term of this patent is extended or adjusted under 35 U.S.C. 154(b) by 0 days.

(21) Appl. No.: 09/519,261

(22) Filed: Mar. 6, 2000

Related U.S. Application Data

(63) Continuation-in-part of application No. 09/265,066, filed on Mar. 9, 1999, now Pat. No. 6,152,792, and a continuation-in-part of application No. 09/183,455, filed on Oct. 30, 1998, now Pat. No. 6,071,156.

(51) Int. Cl.[7] ..... B63H 11/113

(52) U.S. Cl. ..... 440/42; 440/38; 440/111

(58) Field of Search ..... 440/38, 40, 41, 440/42, 66, 67, 111, 112; 60/221, 222

(56) References Cited

U.S. PATENT DOCUMENTS 3,382,833 * 5/1968 Wukowitz ..... 114/289
6,165,029 * 12/2000 Lu ..... 440/30

FOREIGN PATENT DOCUMENTS

1063945 * 4/1967 (GB) ..... 440/42

* cited by examiner

*Primary Examiner*—S. Joseph Morano
*Assistant Examiner*—Ajay Vasudeva
(74) *Attorney, Agent, or Firm*—Baker Botts L.L.P.

(57) ABSTRACT

A waterjet propulsion pump (14) is mounted in an opening in a fully submerged intermediate transom (12) located forward of the stern transom (11) and at the aft end of a dependent structural pod (15) on the hull bottom with the pump discharge nozzle (30) lying aft of the intermediate transom. A steering nozzle (50) is mounted on the discharge nozzle (30) for pivotal movement about an axis that lies in a vertical plane. At least one reversing deflector (100 or 300 and 400) is mounted for pivotal movement about an axis that is perpendicular to the vertical plane. A rotatable steering shaft (70, 270) operated by a steering actuator located with the hull (140 or 340) is coupled to the steering nozzle (50 or 250). A hollow reversing shaft (90, 290) is received telescopically over a portion of the steering shaft and is translatable axially relative to the steering shaft by a reversing actuator (150, 350) located within the vessel hull. A mechanical linkage (110, 310 and 118, 318) coupled between the reversing shaft and the reversing deflector pivots the reversing deflector between an inactive position and an operative position. Fairings (25, 26, 27) fair to the lines of the pod and to each other cover the sides and bottoms of discharge nozzle, steering nozzle and reversing deflector, and the steering and reversing shafts.

10 Claims, 17 Drawing Sheets

SURFACE VESSEL WITH A WATERJET PROPULSION SYSTEM

The present application is a continuation-in-part of U.S. application Ser. No. 09/183,455 filed Oct. 30, 1998, now U.S. Pat. No. 6,071,156 and U.S. application Ser. No. 09/265,066 filed Mar. 9, 1999, now U.S. Pat. No. 6,152,792.

BACKGROUND OF THE INVENTION

In most surface vessels having waterjet propulsion systems, the pump is mounted within the hull adjacent the stern transom with at least a portion of the pump and the pump discharge nozzle above the surface of the water. The water jet is discharged through a discharge conduit leading from the pump that passes through the transom and impinges on a steering nozzle mounted on the outside of the stern transom. The location of the outlet from the pump discharge conduit at the water surface permits the actuators for the steering nozzle and reversing deflector of the propulsion system to be above the water, thus simplifying the installation and maintenance of the actuators and the hydraulic lines leading to the actuators. Also, it is common to provide access ports in the pump above the waterline to permit the pump to be serviced without drydocking the vessel.

Generally, the intake opening to the water supply conduit for the waterjet pump is located on the bottom of the hull a short distance forward of the pump and just far enough below the waterline to ensure that water is taken in under most operating conditions of the vessel. The location of the intake opening at a minimum height below the pump improves efficiency, as compared to a deeper location, by minimizing the vertical distance that the pump has to pump the water from the intake opening to the pump rotor.

A disadvantage of having the waterjet pump relatively close to the water surface is the reduced hydraulic head of water at the pump inlet. The reduced suction head reduces the capability of the pump to absorb high power at slow speeds due to the onset of cavitation.

The pump has to be larger than it would have to be if the suction head were greater in order to provide high power output at slow speeds without cavitation.

Another disadvantage of most previously known waterjet propulsion systems is the relative complexity of the actuators for the steering nozzle and the reversing deflector and the outboard location of the actuators. The actuators are usually hydraulic piston/cylinders and require that several hoses pass through openings in the transom, which complicates the construction of the transom and requires seals in each opening. If there is a failure of an actuator or a hose, hydraulic fluid is lost to the environment. The outboard actuator systems for the steering nozzle and the reversing deflector are also not easily repaired when the vessel is at sea.

One previously known arrangement for actuating the steering nozzle and reversing deflector of a marine waterjet propulsion system, which is described and shown in U.S. Pat. No. 3,807,346, includes concentric shafts that extend vertically downwardly from a portion of the vessel hull that is located above the steering nozzle and reversing deflector, which are pivotally mounted on a bracket for rotation about a common vertical axis that coincides with the axis of the concentric shafts. The lower end of the inner shaft is coupled to the steering nozzle, and the lower end of the outer shaft is coupled to reversing deflector. The inner shaft is driven by a piston/cylinder steering actuator that is located within the vessel hull and is coupled by a steering lever to the upper end of the inner shaft. A piston/cylinder reversing actuator is coupled between the steering lever and the upper end of the outer shaft so as to pivot the reversing deflector relative to the steering nozzle.

The steering/reversing mechanism of U.S. Pat. No. 3,807,346 has the advantages of requiring only a single penetration of the hull of the vessel and of enabling the steering and reversing actuators to be located within the vessel hull, where they are protected from the hostile water environment and can be serviced readily. The rotation of the reversing deflector about a vertical axis is, however, highly disadvantageous, inasmuch as in the retracted position for ahead propulsion, the reversing deflector resides laterally of the steering nozzle where it creates a large drag. In addition, an inactive positioning of the reversing deflector laterally of the steering nozzle requires additional athwart-ship space, which is limited in many waterjet propulsion applications.

When a waterjet propulsion system is installed at the waterline of the vessel, most parts of the installation can be located above the water surface and do not contribute drag. Locating a water jet propulsion system in a fully submerged location to attain the advantages described above presents significant problems from the points of view of minimizing drag, minimizing the number of penetrations of the hull requiring seals, constructing the system so that it can be easily maintained and repaired, and avoiding installing hydraulic or electrical apparatus outside of the hull.

SUMMARY OF THE INVENTION

One object of the present invention is to provide a surface vessel having a waterjet propulsion system that is installed in a position in which it is fully submerged. For any given size of waterjet pump, the pump is capable of absorbing more power at slow speeds without cavitation than previously known vessels propelled by water jets, and the noise and degree of disturbance of the surface of the water generated by the propulsion system are significantly reduced. Another object is to provide a waterjet propulsion system in which the pump is installed in a mechanically and structurally efficient manner on a specially configured hull that enables the pump to be installed and serviced from outside the hull and the actuators for a steering nozzle and a reversing deflector to be located within the hull. It is also an object to provide a waterjet propulsion system that is mechanically and structurally efficient, relatively simple in construction, extremely robust, compact in size, and of low weight.

An additional object is to have the reversing deflector mounted for pivotal movement about a horizontal axis so that when it is positioned for ahead propulsion, it lies above the steering nozzle where it takes up less athwart ship space and produces less drag than it would in a position laterally of the steering nozzle. A further object is to provide actuation of the steering and reversing apparatus by mechanisms that are compact in size, of low weight, and very rugged, that generate rotational and translational motions, respectively, that require only one penetration of the hull, and in which all or nearly all components located outside the hull are mechanical, thus minimizing the possibility of leakage of a hydraulic fluid into the water.

The foregoing and other objects are attained, in accordance with the present invention, by a surface vessel which has a hull having an aft portion that includes a main stern transom, an intermediate transom located below and forwardly of the main transom, and an aft bottom section that extends from the lower edge of the main stern transom forwardly to a location generally above and proximate to the intermediate transom. A water intake conduit has an inlet opening in the hull forward of the intermediate transom and an outlet opening within the hull forward of the intermediate transom. A waterjet propulsion pump is mounted in an opening in the intermediate transom and includes a forward part connected forward of the intermediate transom to the outlet of the intake conduit and an aft part extending aft from the intermediate transom. A pump rotor is received in the forward part and a stator received in the aft part. A steering nozzle is pivotally mounted on the aft part of the pump housing to intercept a water jet discharged from the pump and coupled to the lower end of a steering shaft that is rotatable about a steering axis and extends upwardly from the steering nozzle through an opening in the aft bottom section and has an upper end portion located within the hull. A steering actuator located within the vessel hull is coupled to the steering shaft for rotating the steering shaft about the steering axis. According to one aspect, the present invention is characterized in that at least an aft portion of the intake conduit and the forward part of the pump housing are received in a downwardly extending protuberance forming a portion of the hull structure and having an aft end joined to the intermediate transom. The protuberance is hydrodynamically shaped and faired to portions of the bottom of the hull forward and abreast of the protuberance.

The protuberance or pod as the mounting site of the waterjet pump and the associated steering system presents a small aft-facing area on the submerged part of the hull, thus minimizing drag. The rounded shape of the pod on the sides and bottom and the structural integration of the pod with the hull and the intermediate transom makes the pump mounting site strong for load support and transfer of reaction loads from the pump to the vessel hull. The pod also allows the steering nozzle to lie below the aft bottom section so that the steering shaft can extend up through a single opening in the aft bottom section of the hull and the steering actuator can be within the hull. The pump mounting arrangement of the present invention also allows the pump to be serviced from outside the hull by disassembly of the aft part of the pump, inasmuch as the forward part of the pump housing and the intake conduit are water-tight. That makes it possible to mount the pump well below the waterline without also making it necessary to drydock the vessel for pump maintenance.

The mounting of the pump in the secondary transom is conducive to the use of either a mixed flow pump or an axial flow pump. In either case, it is preferred that the pump, the discharge nozzle, and the steering nozzle be aligned on a common axis, which facilitates manufacture and assembly and avoids losses due to turning of the water flow as it passes through the pump. It will often be desirable for the common axis to slope downwardly and rearwardly at an acute angle relative to the base line of the hull so the water jet is discharged with a small downward velocity component in all conditions of forward propulsion of the vessel. The slight downward direction of the water jet minimizes perturbation of the jet by impingement of the jet on the portion of the hull bottom aft of the pump installation site and also contributes to noise attenuation and reduction in the magnitude and intensity of the wake due to the water jet—the water jet is driven somewhat downwardly into the water in the wake of the vessel and tends to dissipate well below the surface.

In some previously known waterjet pump installations, a reversing deflector is mounted for pivotal movement about a reversing pivot axis for movement between an inactive position substantially clear of a water jet discharged from the steering nozzle and an operative position in which the water jet impinges on a surface of the reversing deflector that is configured to reverse the direction of the water jet to a direction having a forward vector. According to a further aspect of the present invention, a waterjet pump installation is further characterized in that the reversing pivot axis is perpendicular to a vertical plane and spaced apart from the steering shaft, a hollow reversing shaft is received telescopically over a portion of the steering shaft and is translatable axially relative to the steering shaft, and a mechanical linkage is coupled between the reversing shaft and the reversing deflector so as to pivot the reversing deflector between the inactive position and the operative position in response to axial translation of the reversing shaft.

The simplicity and durability of concentric shafts for moving and positioning the steering nozzle and reversing deflector and the location of the actuators within the hull enable reductions in the costs of design, manufacture and installation, facilitate inspection and servicing, minimize possible loss of hydraulic fluid (in the case of hydraulic actuators) to the environment, and minimize the possibility of damage from impacts. All or most components outside the hull are mechanical, and the number of openings through the hull for steering and reversing control is minimized. The shaft design and inboard location of the actuators also provide design flexibility in the types and configurations of the steering and reversing actuators. Suitable actuators include hydraulic piston/cylinders (rams), electric motors/reducing gear transmissions, and ballscrew drives. In the case of the steering actuator, a vane-type rotary hydraulic actuator is preferred for its compact size, low weight, and reasonable cost. Advantageously, again for size, weight and cost advantages, an annular piston/cylinder ram affixed within the hull and coupled to the reversing shaft is preferred for the reversing actuator.

An especially important advantage of the present invention is derived from the mounting of the reversing deflector for pivotal movement about a horizontal axis aft of the steering axis so that the reversing deflector in an inactive position for forward propulsion resides above the steering nozzle, where it is in the "shadow" of an upper portion of the intermediate transom on which the discharge nozzle of the waterjet pump is installed, thus minimizing drag.

The mechanical linkage between the reversing shaft may include a Scott-Rouselle mechanism coupled to the reversing shaft and having a pivot output and a reversed crank-slider mechanism coupled to the reversing deflector and a pivot input coupled to the pivot output of the Scott-Rouselle mechanism. Such mechanisms are, preferably, provided in pairs that are located and constructed symmetrically with respect to the vertical plane the includes the axis of the pump discharge nozzle.

The reversing deflector may be pivotally mounted on the steering nozzle so that it rotates about the steering axis with the steering nozzle. In that arrangement the reversing shaft and the steering shaft are coupled to rotate conjointly so that astern propulsion forces with lateral components are provided.

In other embodiments of the present invention, upper and lower reversing deflectors are mounted on the steering nozzle for rotation about parallel transverse axes perpendicular to a vertical plane. The upper reversing deflector, when in its inactive position, resides above the steering nozzle and is actuated by a reversing shaft that is received telescopically over the steering shaft and a linkage coupled between the reversing shaft and the upper deflector. The lower deflector is mounted on the steering nozzle such that in its inactive position it lies below the outlet from the steering nozzle and is linked to the upper steering deflector so that movements of the upper and lower reversing deflectors between the inactive and active positions are coordinated. When in their active positions, the upper and lower deflectors abut each other and together form a surface that intercepts the water jet and deflects it so that it has a forward vector. Among the advantages of having upper and lower deflectors are that each may be smaller than a single deflector to have the same effect in redirecting the water jet and thus is subjected to a reduced load, and force components exerted vertically on the respective deflectors tend to cancel out, thus minimizing a vertical load transfer to the vessel, especially during the transient state when the reversing deflectors are being moved from the inactive to the active positions.

It is advantageous, according to the present invention to provide fairings over the parts of the pump located aft of the intermediate transom and over the steering/reversing units. Suitably, a first stationary fairing unit extends aft from the secondary transom to a location just forward of a transverse plane that includes the steering axis, downwardly from the aft bottom section and under the aft part of the pump housing. A second fairing unit is mounted on the steering nozzle for rotation therewith and extends aft from the aft end of the first fairing unit to a location proximate to a transverse plane parallel to the steering shaft and including an aft extremity of the reversing deflector and downwardly from the aft bottom section and has an opening on its underside that allows the water jet deflected by the reversing deflector to pass the second fairing and under the aft part of the pump housing. When upper and lower reversing deflectors are provided, a third fairing unit is affixed to the lower reversing deflector and fills the opening in the bottom of the second fairing unit.

DESCRIPTION OF THE DRAWINGS

For a more complete understanding of the present invention, and the advantages thereof, reference may be made to the following written description of exemplary embodiments, taken in conjunction with the accompanying drawings.

Figure 13:
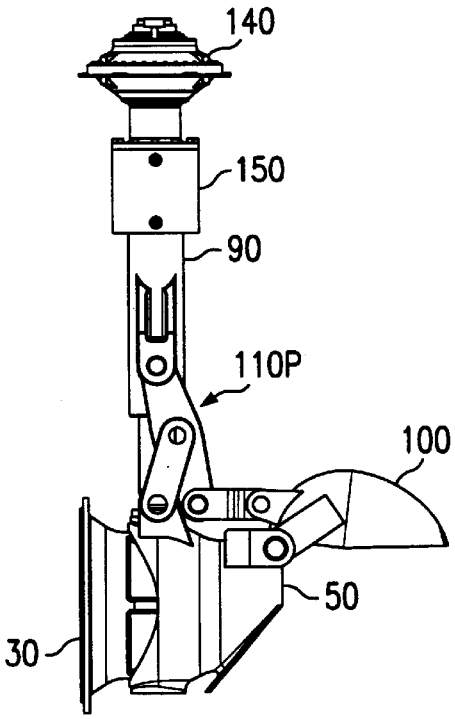
Figure 14:
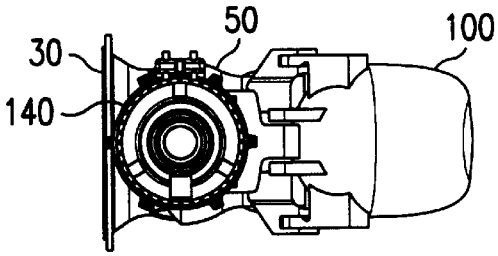
Figure 15:
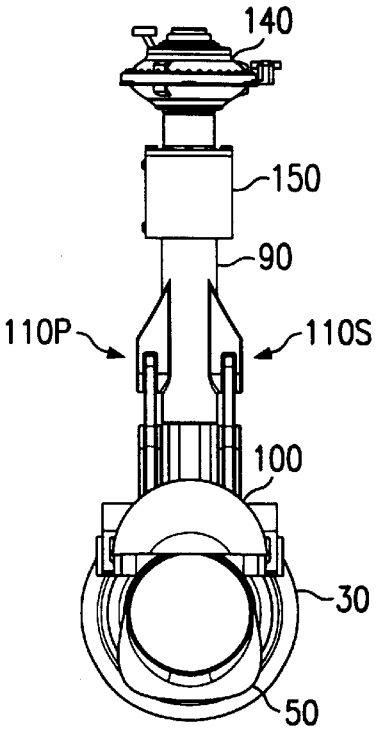
Figure 16:
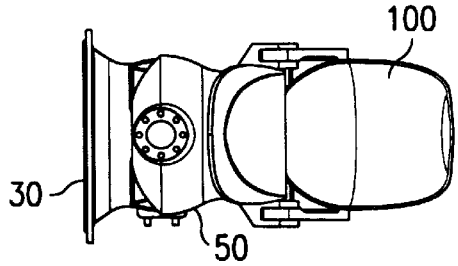
Figure 17:
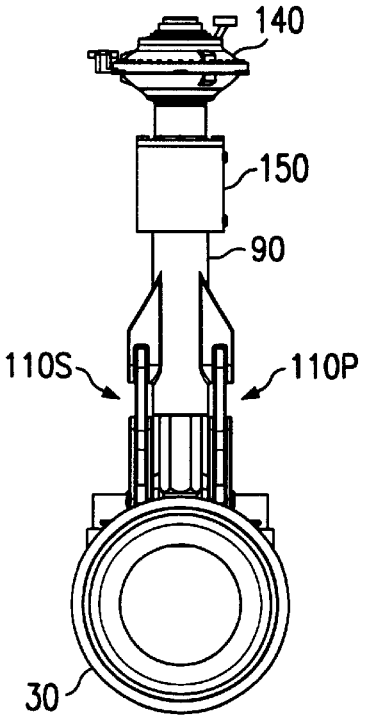
Figure 18:
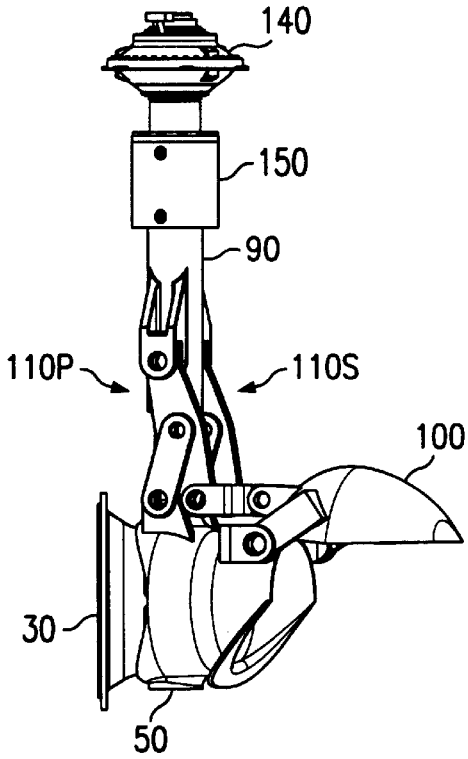
Figure 19:
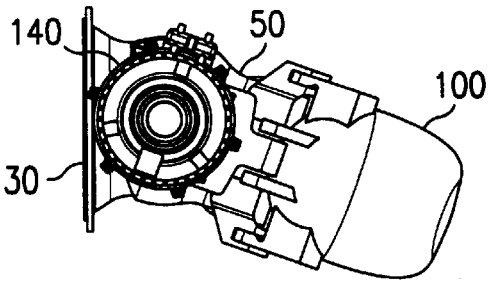
Figure 20:
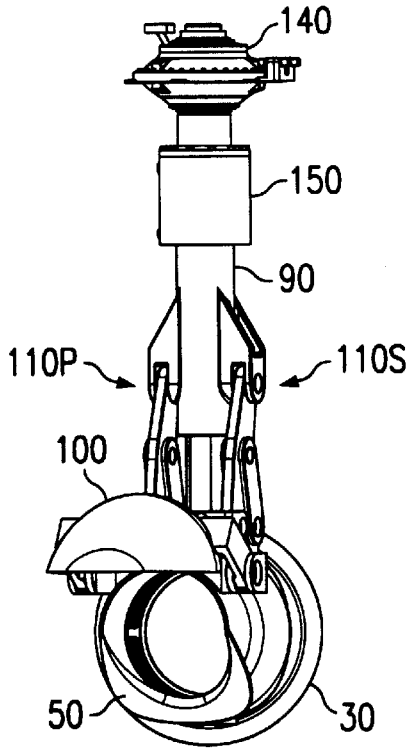
Figure 22:
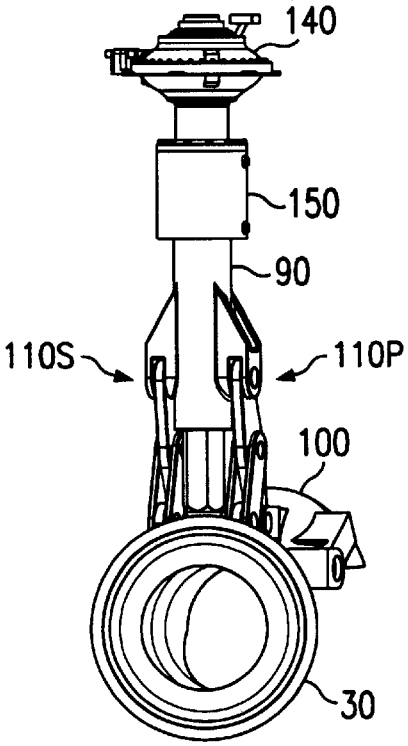
Figure 21:
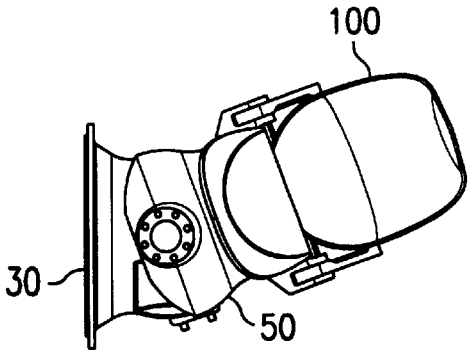
Figure 23:
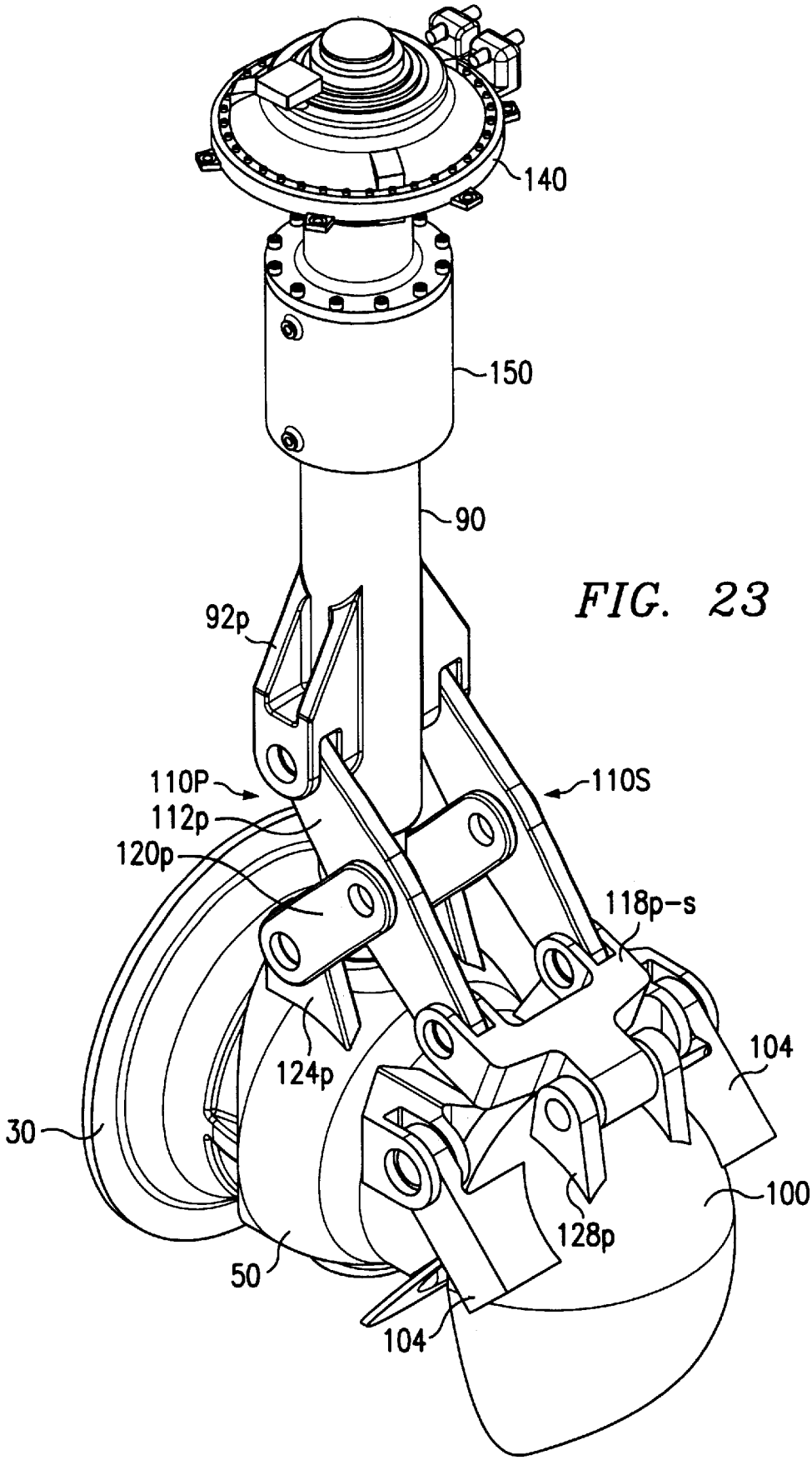
Figure 24:
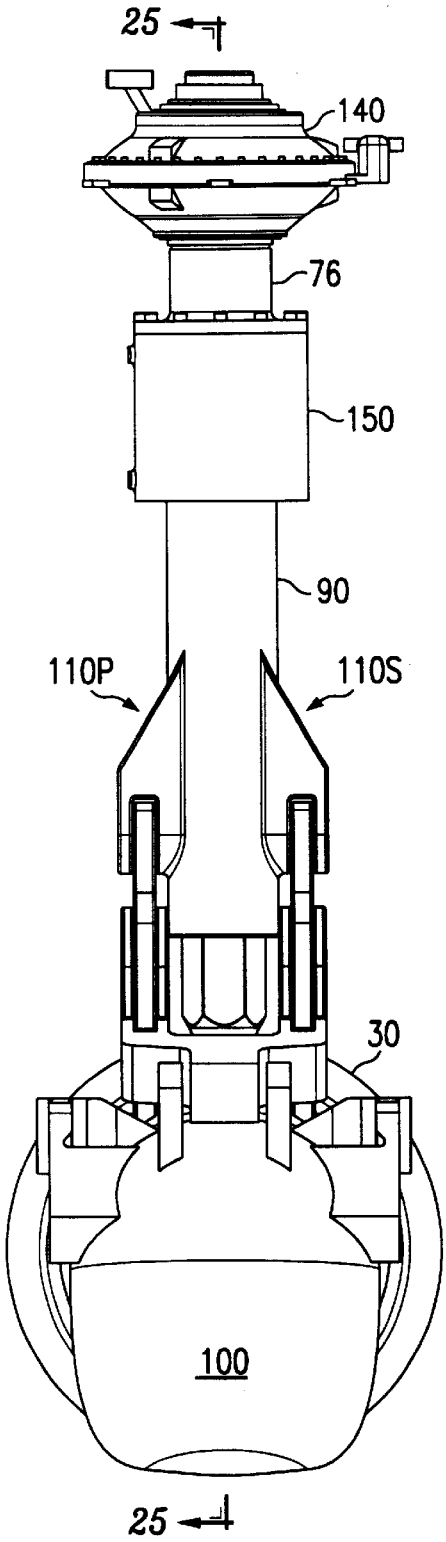
Figure 25:
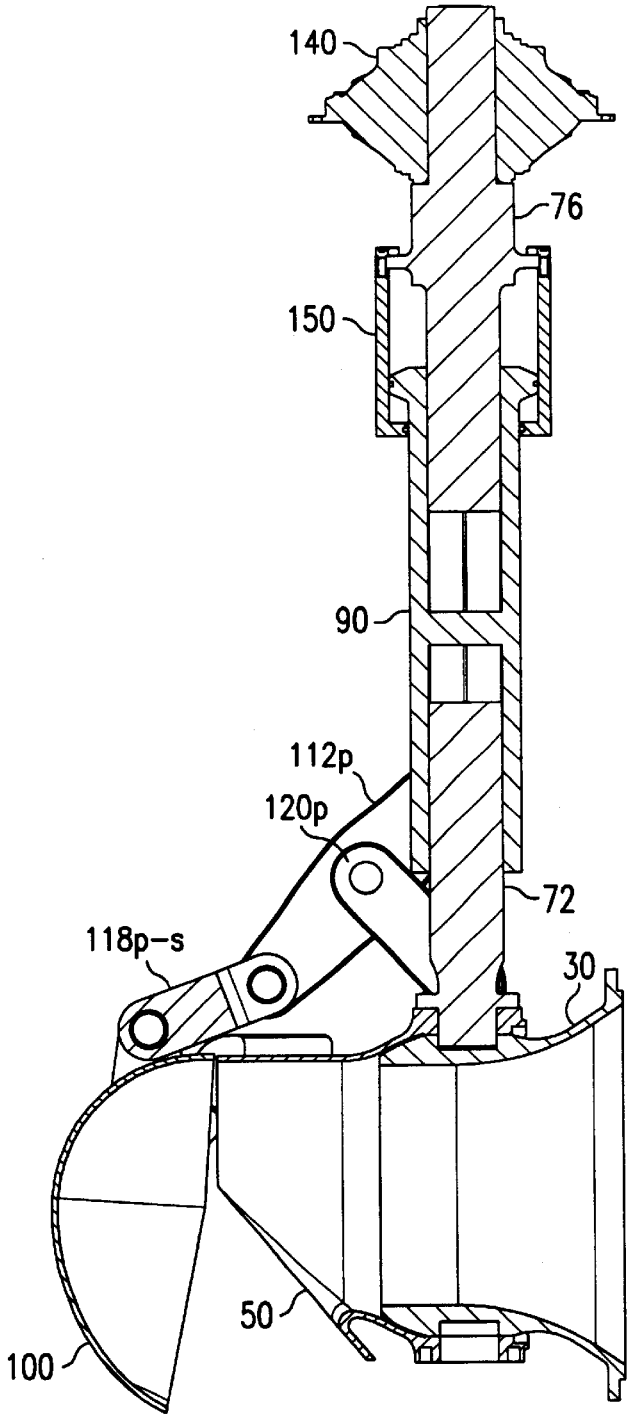
Figure 26:
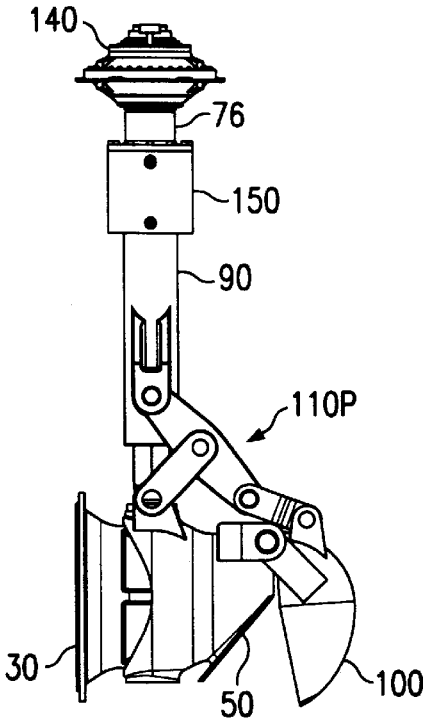
Figure 27:
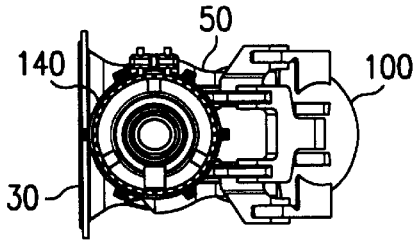
Figure 29:
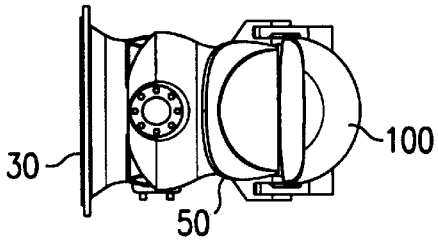
Figure 28:
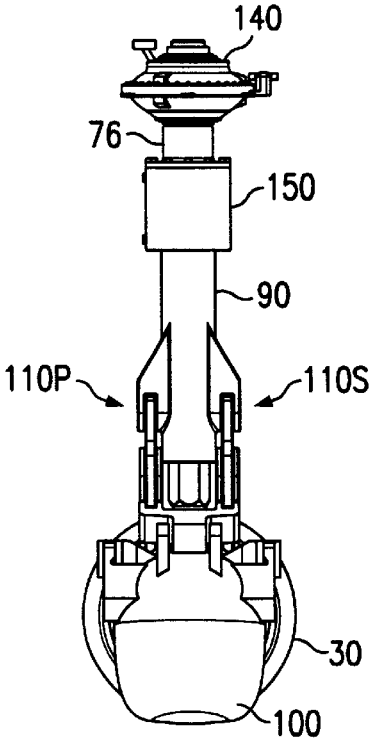
Figure 30:
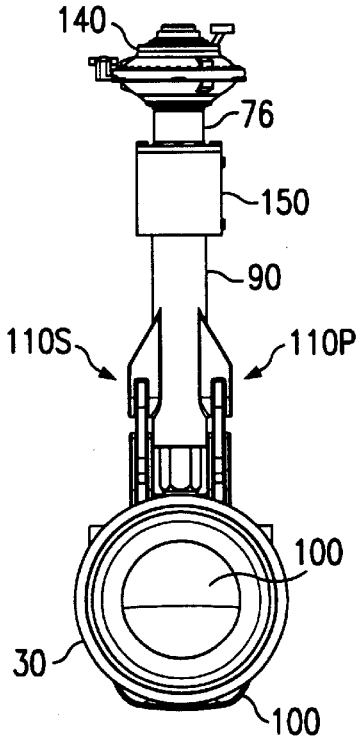
Figure 32:
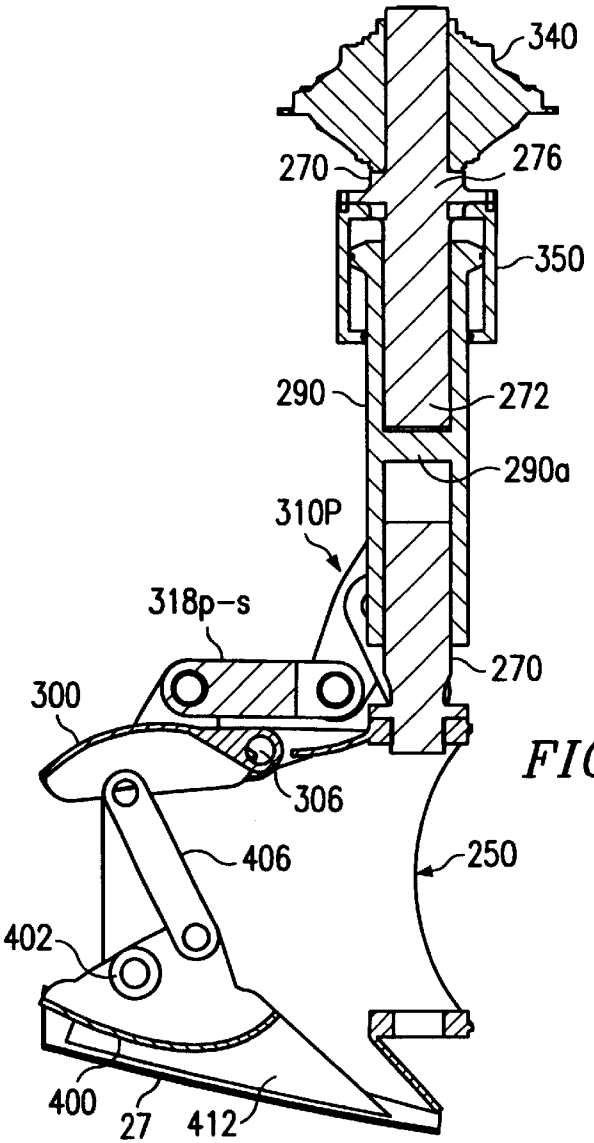
Figure 31:
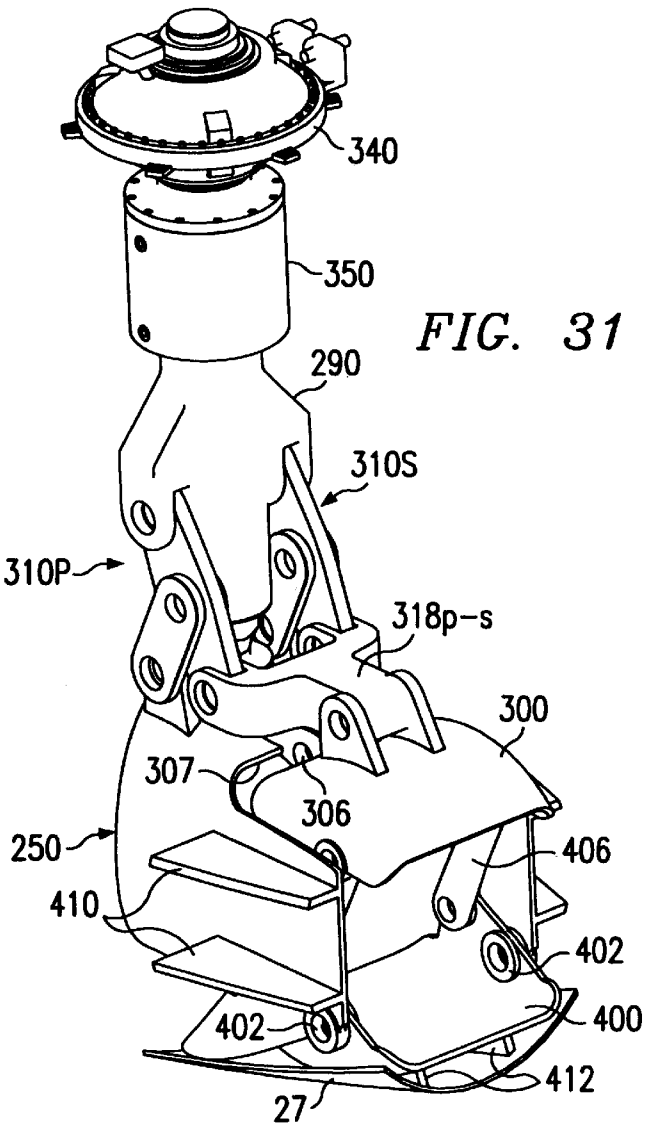
Figure 33:
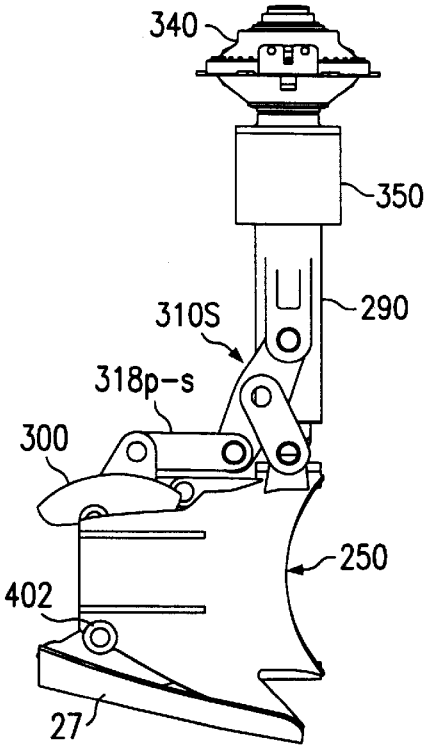
Figure 34:
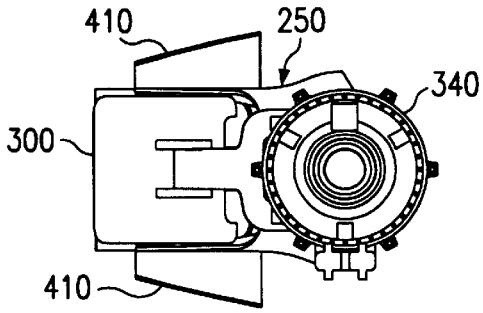
Figure 36:
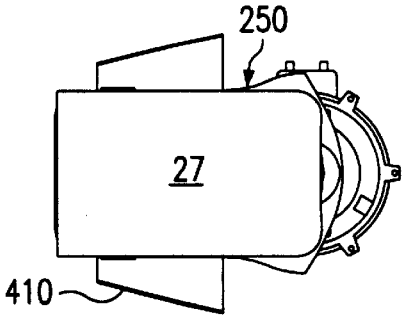
Figure 35:
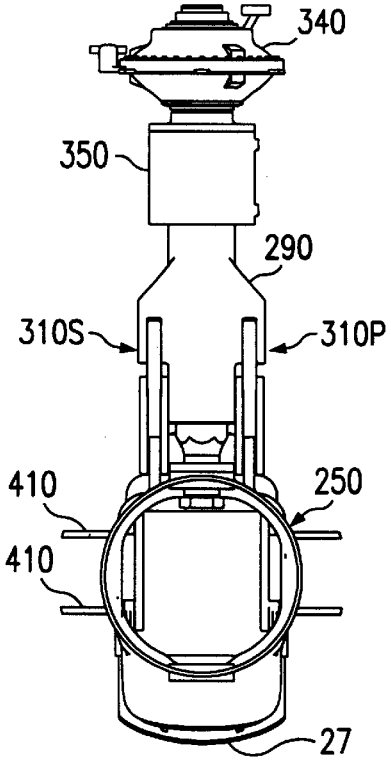

The following Figures show the first embodiment in straight-ahead forward mode:

FIG. 13—port side elevational;

FIG. 14—top plan;

FIG. 15—rear elevational;

FIG. 16—bottom plan;

FIG. 17—front elevational;

The following views show the first embodiment in full port ahead mode:

FIG. 18—port side elevational;

FIG. 19—top plan;

FIG. 20—rear elevational;

FIG. 21—bottom plan;

FIG. 22—front elevational;

FIGS. 23 to 25 are the same as FIGS. 9 to 12 except for showing the reversing apparatus in the operational position;

The following views show the first embodiment in the straight astern mode—reversing apparatus in the operational position:

FIG. 26—port side elevational;

FIG. 27—top plan;

FIG. 28—rear elevational;

FIG. 29—bottom plan;

FIG. 30—front elevational;

FIG. 31 is a port side three-quarter pictorial view of a second embodiment taken from a point of view aft of and above;

FIG. 32 is a starboard side cross-sectional view of the second embodiment taken along the vertical centerline;

The following views show the second embodiment in the straight ahead steering mode and the reversing apparatus in the inactive position:

FIG. 33—starboard side elevational;

FIG. 34—top plan;

FIG. 35—rear elevational;

FIG. 36—bottom plan; and

Figure 37:
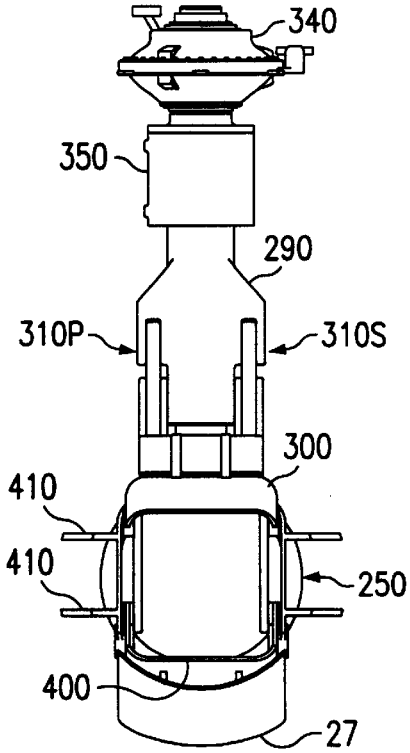

FIG. 37—front elevational.

DESCRIPTION OF THE EMBODIMENT

The hull section shown in FIGS. 1 to 8 is cut away at approximately the waterline and just forward of the prime movers E of twin waterjet propulsion systems, which are located on the vessel such that the discharge nozzles of the water jet pumps and the steering/reversing units that alter the directions of the water jets discharged from the discharge nozzles for steering and reversing the vessel are located well below the waterline. The prime movers E may be gasoline or diesel engines, gas turbines, or electric motors. The hull has a hull bottom 10, a stern transom 11, an intermediate transom 12 that provides the mounting location for two waterjet pumps 14 (described below), and an aft bottom section 10*a* that extends from the lower edge of the stern transom forwardly to the intermediate transom. The forward part of each waterjet pump and the aft part of an associated intake conduit 17 are received in a dependent protuberance or "pod" 15 that forms a structural part of and is faired to the hull bottom and is of a bulbous shape and contoured for hydrodynamic efficiency. The intermediate transom 12 is joined to the hull bottom 10 and the pods 15 along the entire athwartship extent of the ship and has openings that receive the waterjet pumps 14. The aft end of each pod 15 is located at and strongly joined structurally to the intermediate transom. The athwartship portions of the hull bottom 10 between the pods 15 and laterally outboard of the pods are faired to the lines of the hull bottom. A box-like top closure 16 overlies each pod 15, parts of the hull bottom between and laterally abreast of the pods, and part of the aft bottom section 10*a*, is structurally part of the hull bottom 10, and has a deck 16*d* that serves as a mounting site for supports/seals of steering/reversing shafts and steering and reversing actuators (described below).

The two propulsion systems of the surface vessel shown in FIGS. 1 to 8 of the drawings are identical. From this point on, only one is described, with the understanding that the description is applicable to both systems.

An intake conduit 17 leads from an inlet opening 18 in the hull bottom 10 to a flanged outlet opening 170 forward of the intermediate transom 12. An aft flange 19*af* of a forward part 19 of the housing of the waterjet pump 14 is bolted to the aft face of the intermediate transom 12. The flanged forward end 19*ff* of the forward housing part 19 is bolted to the outlet opening 170 of the intake conduit. A drive shaft 20 that is driven by the prime mover E leads into the conduit 17 through a packing and passes through and is coupled to the rotor 21 of the pump 14. A bearing 22 for the tail end of the shaft 20 is located in a hub of a pump stator 23. The peripheral housing part 23h of the stator has a front flange 23*ff* that is co-bolted with the aft flange 19*af* of the forward housing part 19 to the intermediate transom 12. The aft housing part 23*h* extends aft from the intermediate transom and receives at its aft end a pump discharge nozzle 30, which has a flange 32 by which it is bolted to the aft end of the aft housing part 23*h* of the pump. (The peripheral shells of the pump stator and the pump discharge nozzle are sometimes referred to herein as the "aft part of the pump housing.") A steering/reversing unit, two embodiments of which are shown in the drawings and described below, is associated the pump discharge nozzle 30.

The pump 14 and the pump discharge nozzle 30 are aligned axially and are inclined slightly downward from fore to aft so that water jet is discharged with a downward velocity component, with the benefits described above.

A first fixed fairing unit 25 that is fair to the aft end of the pod 15 and the underside of the hull bottom 10 above the parts of the steering/reversing unit located aft of the pod and below the hull bottom is detachably fastened to the pod and the hull bottom. It is not part of the hull structure and is readily detachable to facilitate removal for maintenance and repair of the pump and steering/reversing unit. A second fairing unit 26 is attached to the steering nozzle so that it rotates with the steering nozzle. A third fairing unit 27 is attached to a lower reversing deflector (described below). The first and second fairing units may be unitary or composed of multiple pieces. A single panel is quite suitable for the third fairing unit. The regions of the first and second fairing units where they meet must be configured to allow the steering nozzle and the second fairing to pivot relative to the first fairing unit about the steering axis.

Figure 1:
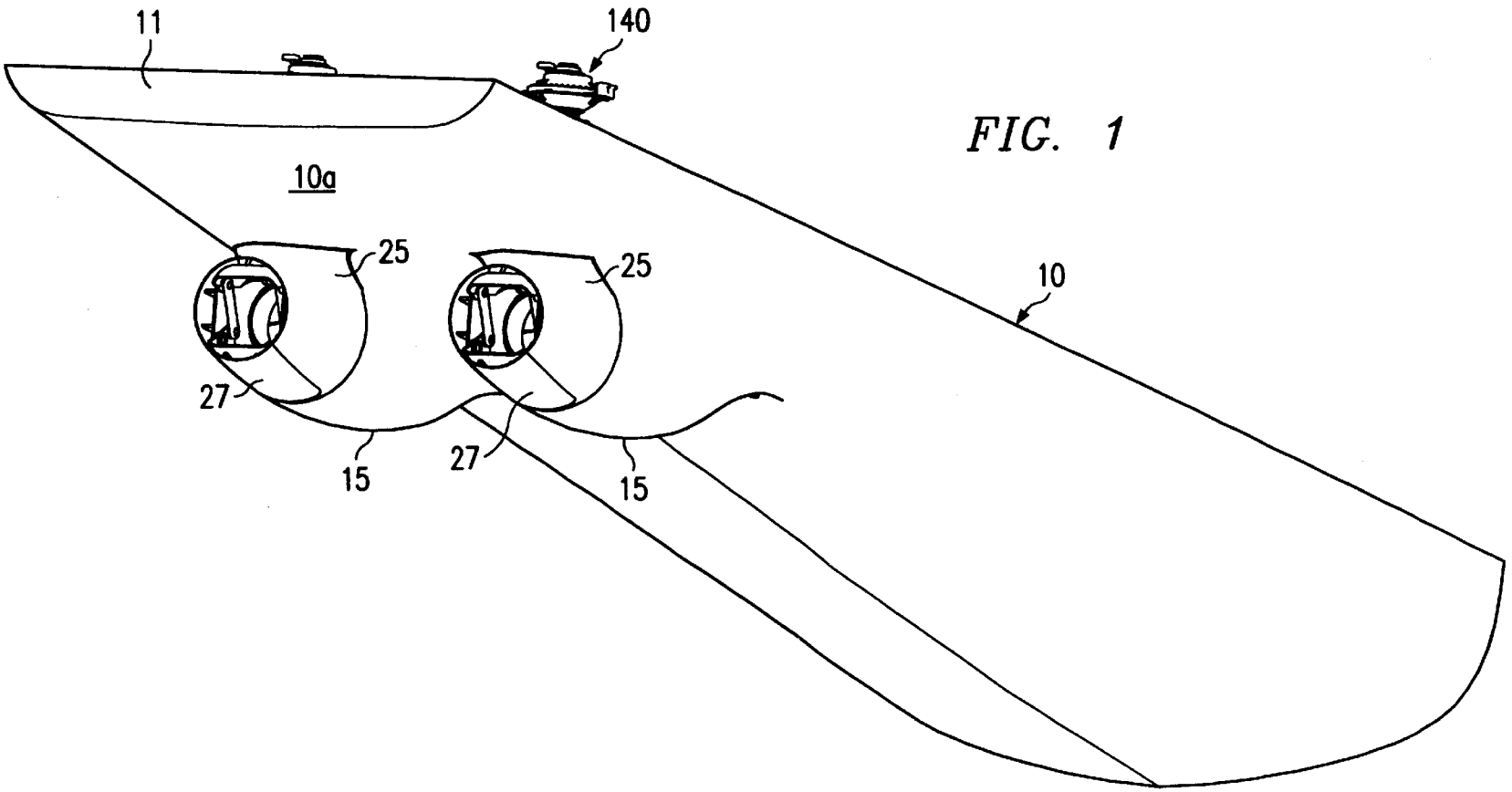
FIG. 1 is a generally schematic perspective view, from a vantage point aft, below and to starboard, of a cut-away aft bottom part of the hull of a ship that is powered by twin waterjet propulsion systems, each of which embodies the present invention.
Figure 2:
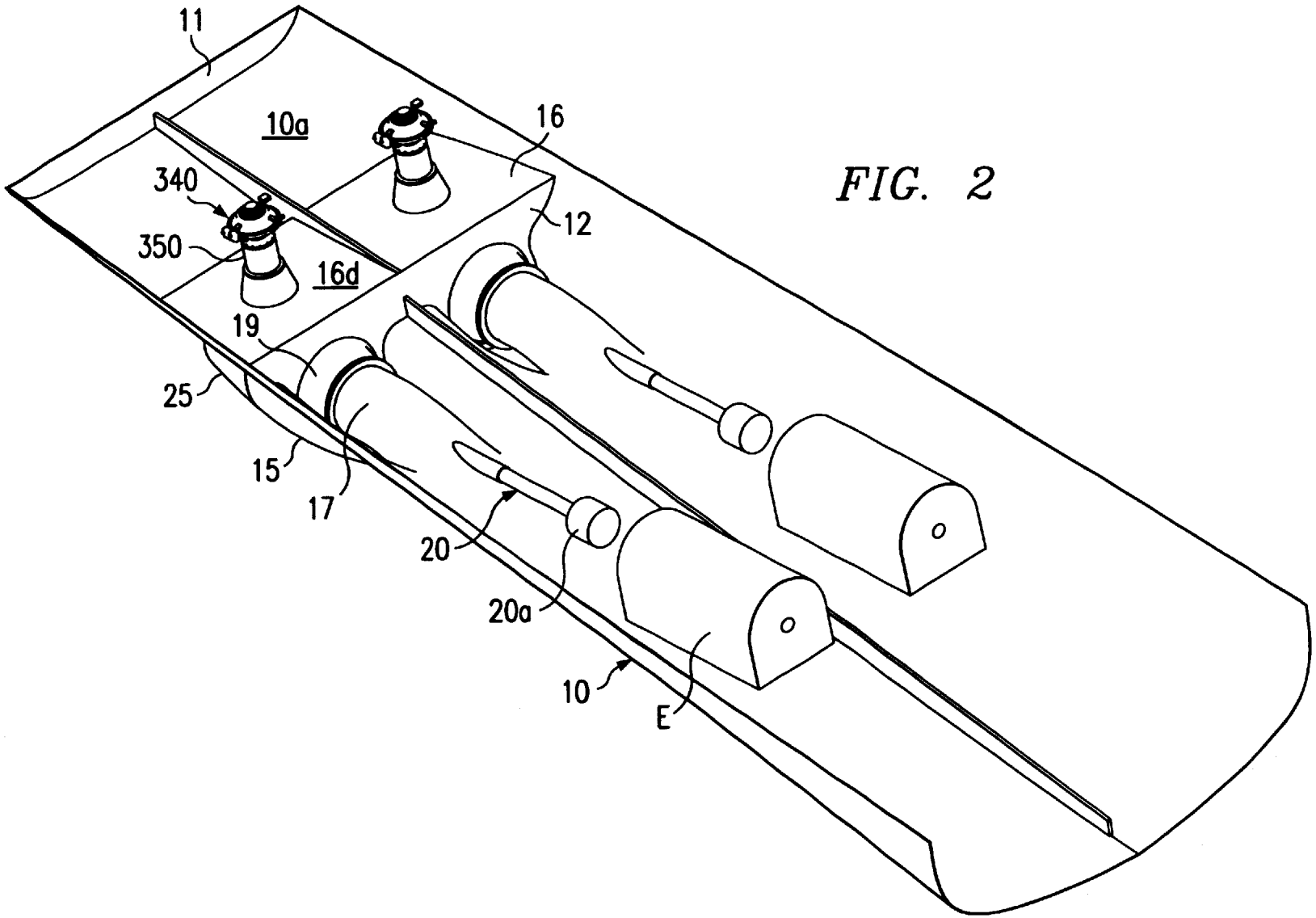
FIG. 2 is a generally schematic perspective view of the cutaway hull shown in FIG. 1, taken from forward, above and to starboard.
Figure 3:
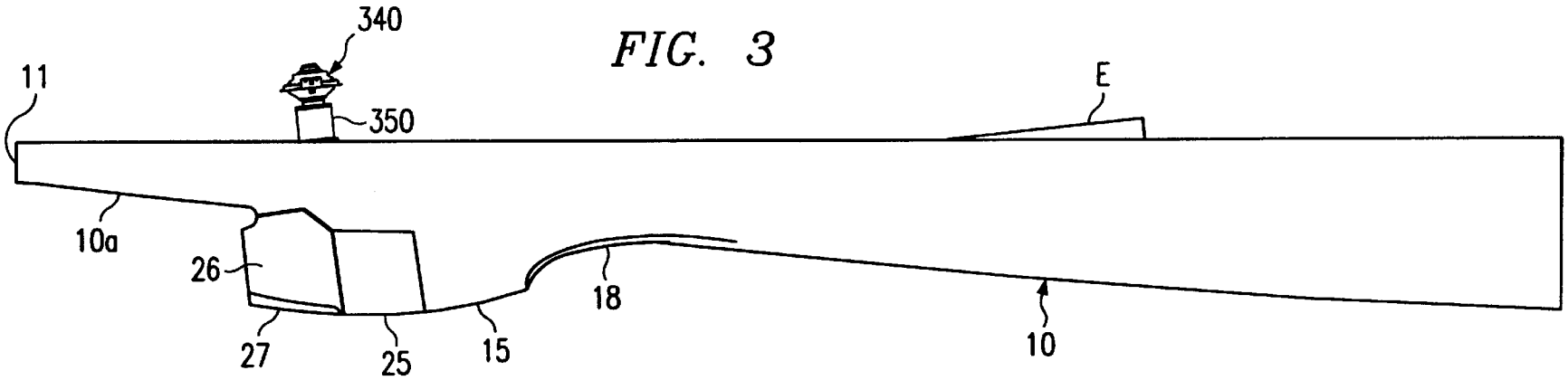
FIG. 3 is a generally schematic side elevational view of the cutaway hull section shown in FIGS. 1 and 2.
Figure 4:
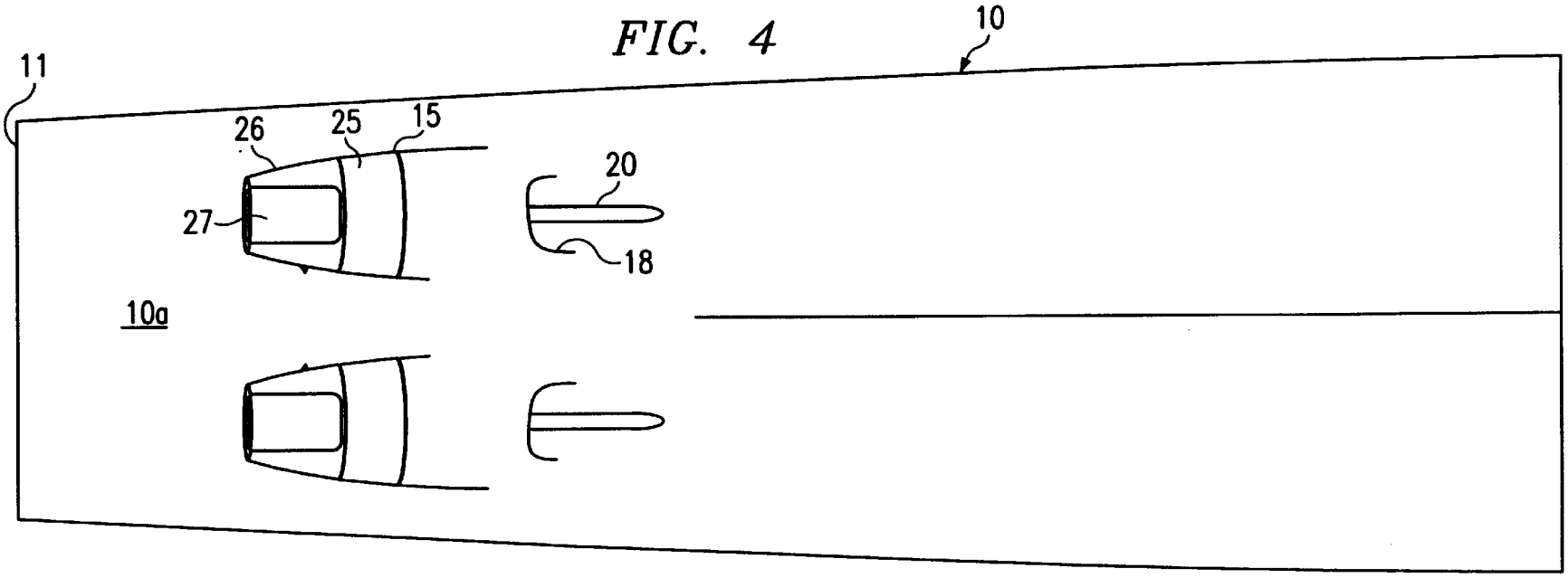
FIG. 4 is a generally schematic bottom plan view view of the cutaway hull section shown in FIGS. 1 to 3.
Figure 5:
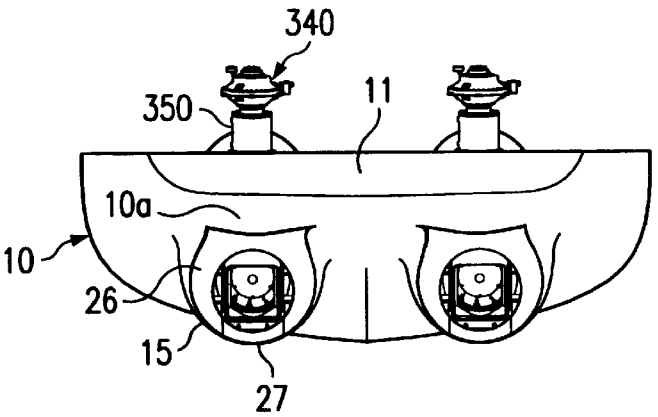
FIG. 5 is a generally schematic rear elevational view of the cutaway hull section shown in FIGS. 1 to 4.
Figure 6:
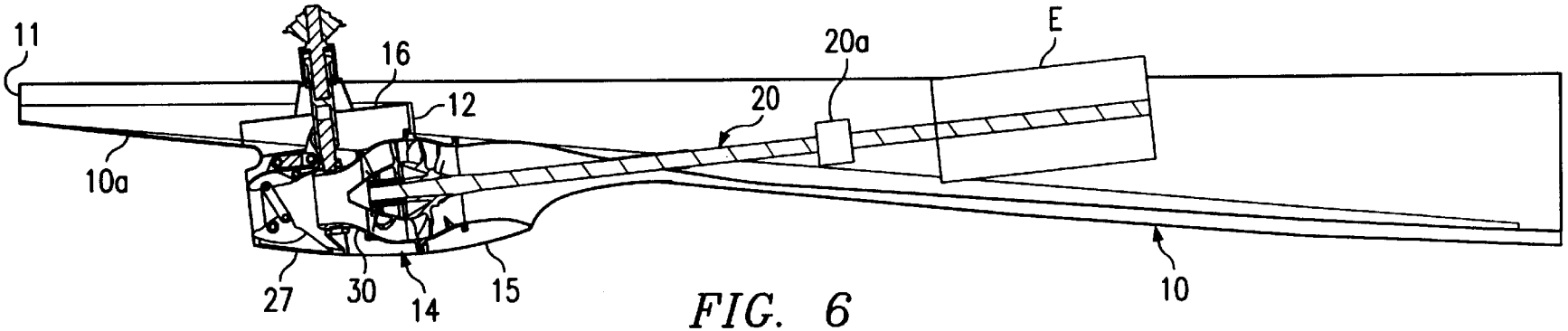
FIG. 6 is a generally schematic side cross-sectional view of the cutaway hull section, taken along the centerline of the starboard propulsion system, of the ship shown in FIGS. 1 to 5.
Figure 7:
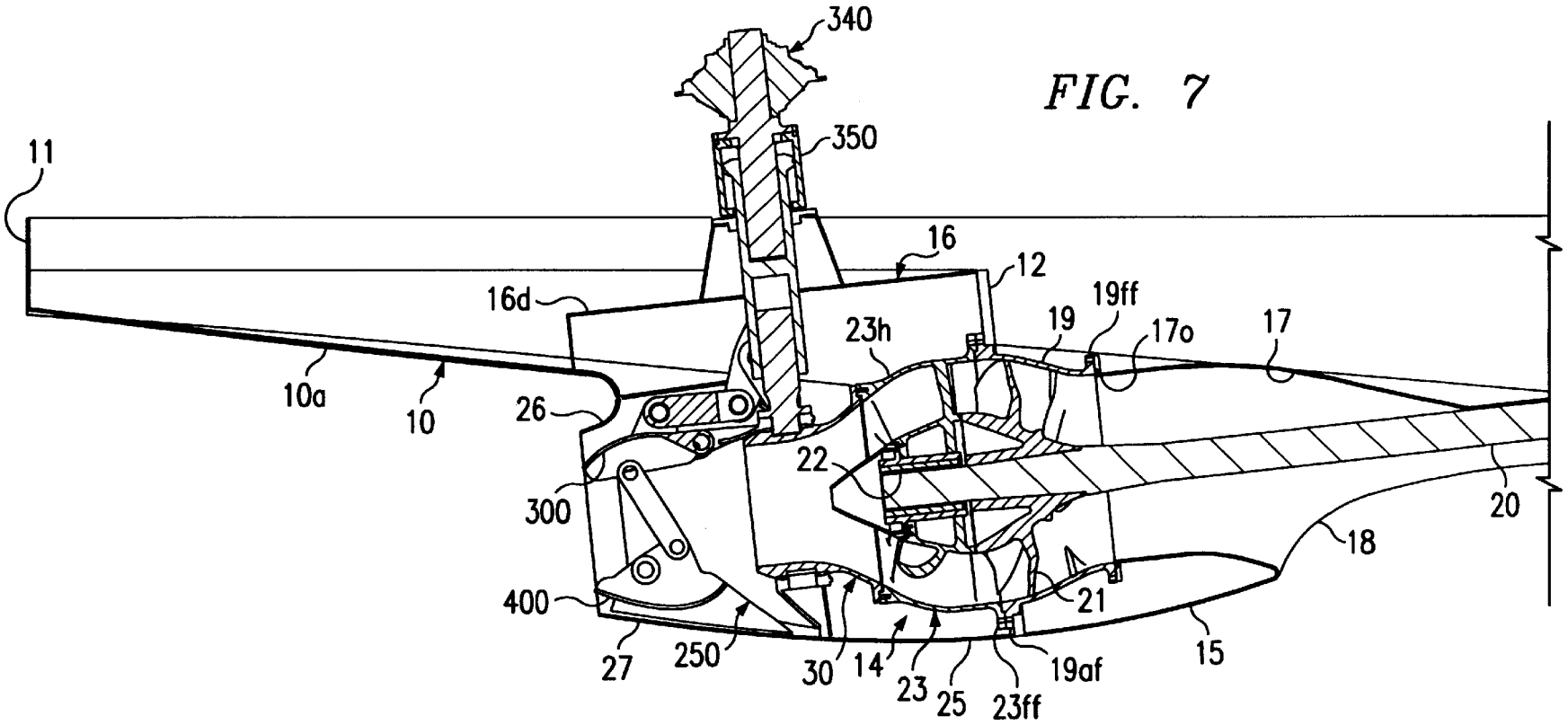
FIG. 7 is an enlargement of the left part of FIG. 6.
Figure 8:
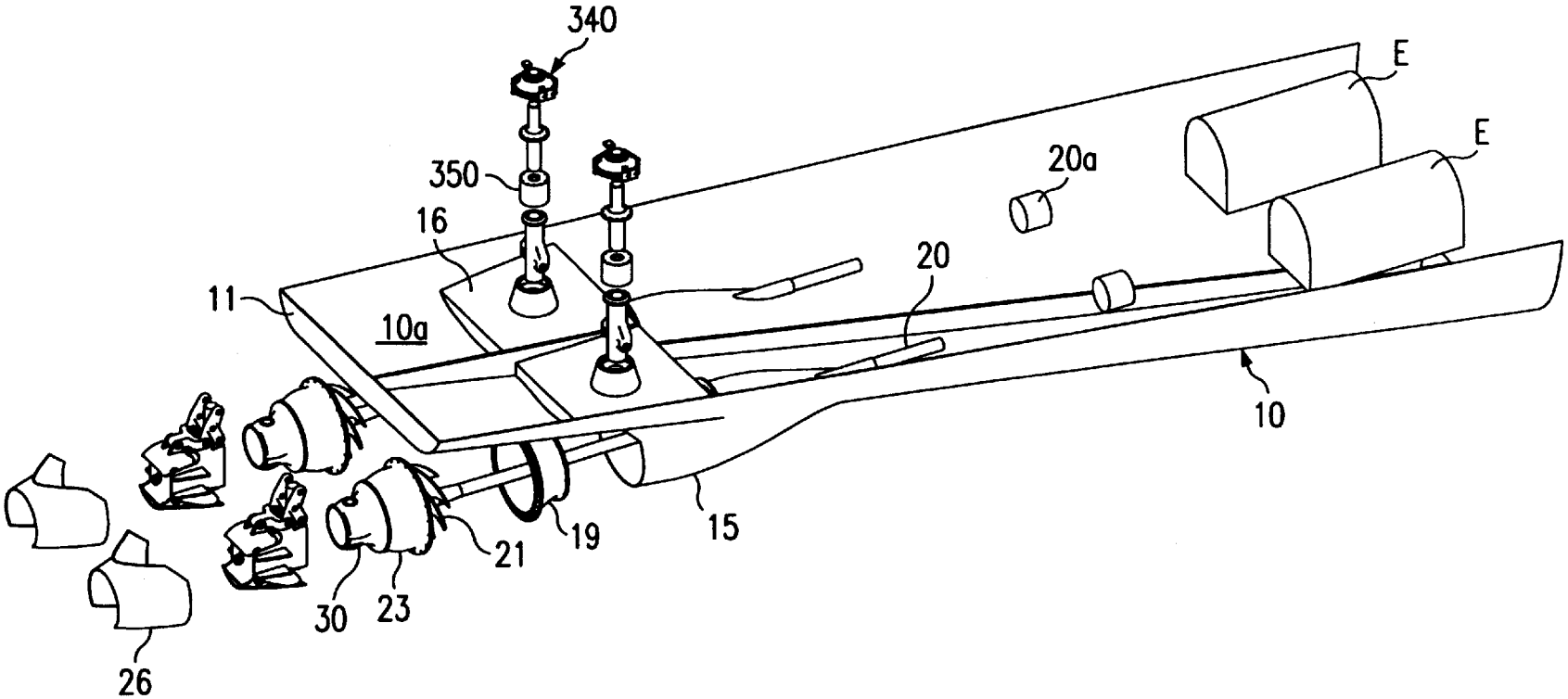
FIG. 8 is an exploded pictorial view of the hull section shown in FIGS. 1 to 7.
Figure 9:
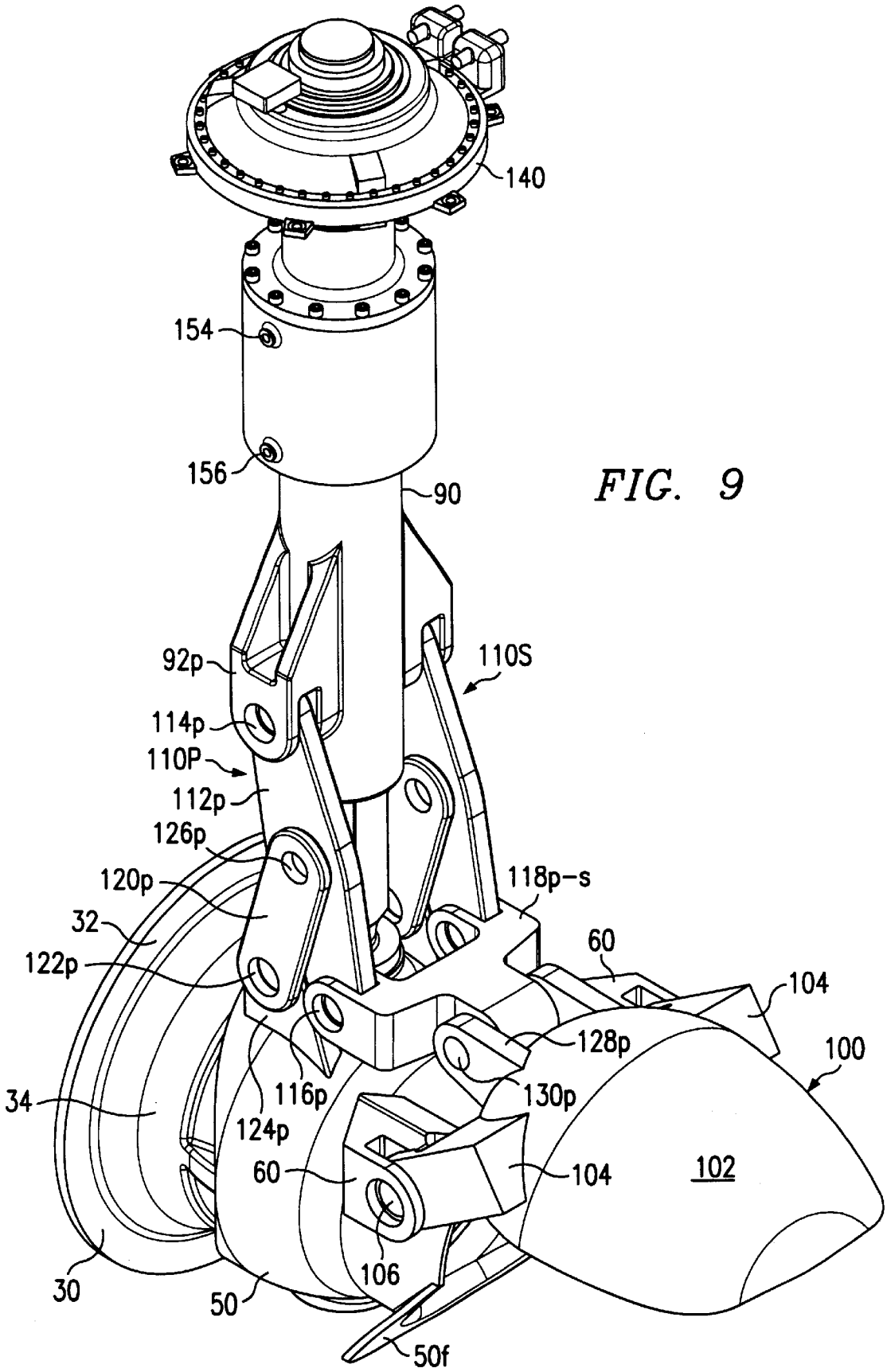
FIG. 9 is a generally schematic pictorial view of a first embodiment of a steering and reversing unit suitable for use in a waterjet propulsion system according to the present invention, the view being taken from a vantage point aft of, above and to port and showing the unit positioned for straight and ahead propulsion.
Figure 10:
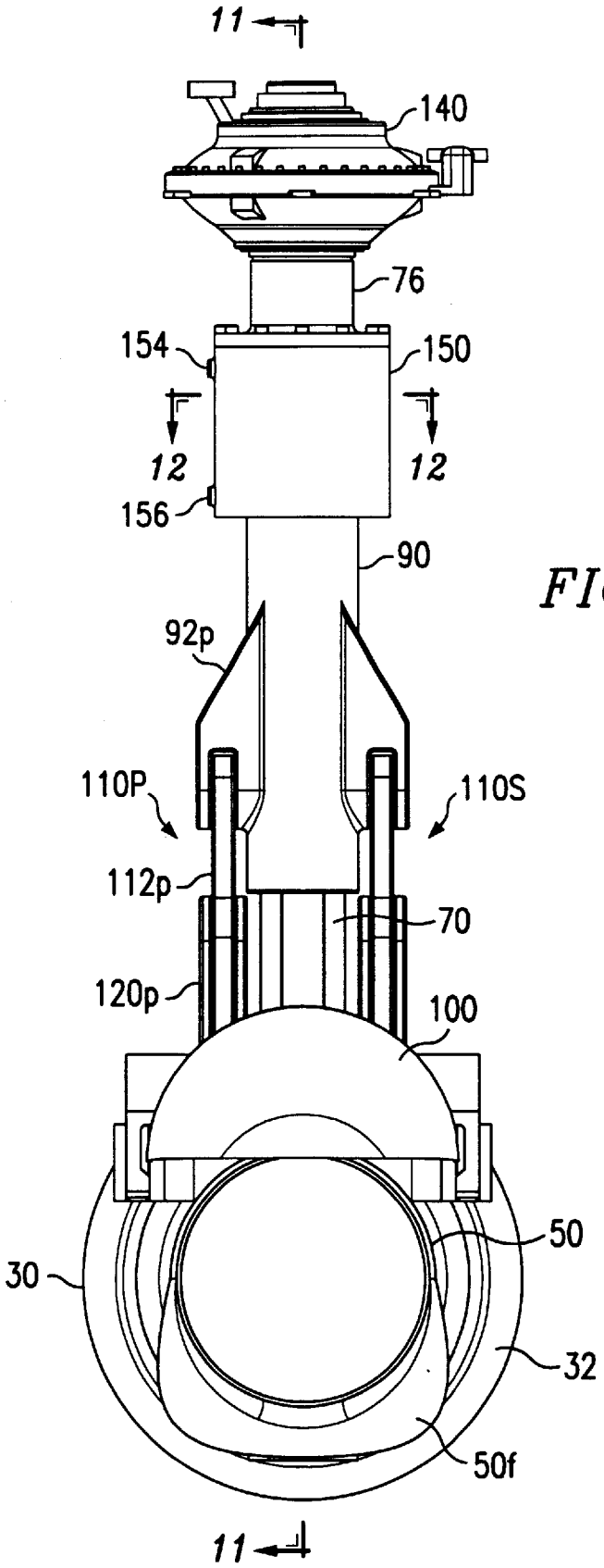
FIG. 10 is rear elevational view of the first embodiment, also showing it set for straight ahead propulsion.
Figure 11:
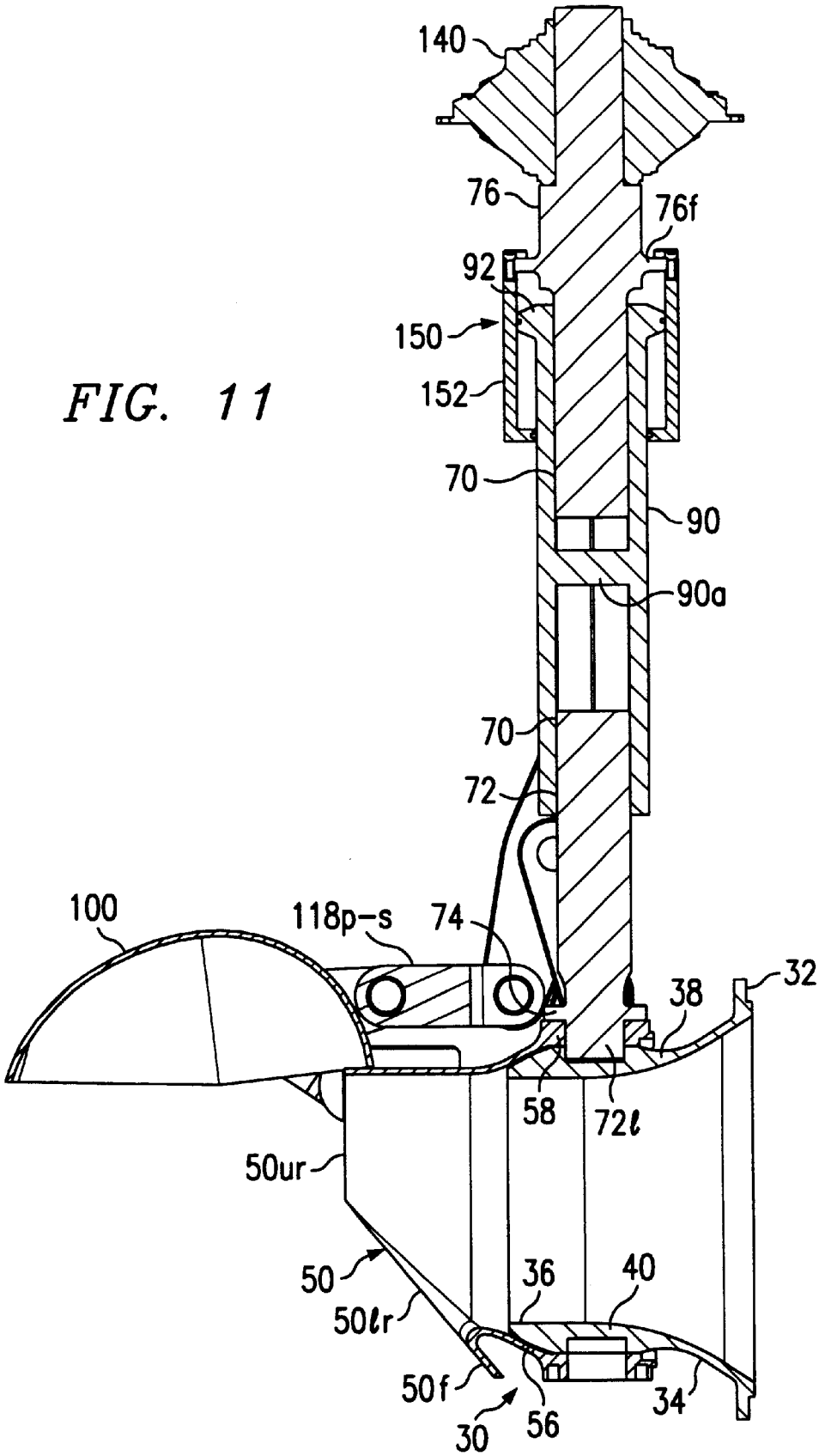
FIG. 11 is a generally schematic starboard side cross-sectional view of the first embodiment, taken along the lines 11—11 of FIG. 10.

As is apparent from FIG. 8, the propulsion unit is installed on the vessel from outside the hull by the following steps in order:

1-Insert the forward pump housing 19 into the hole in the intermediate transom 12 and bolt it to the intake conduit 17;

2-Insert the shaft 20 through the packing of the discharge conduit 17 and a thrust bearing 20*a* and couple it to the prime mover E;

3-Install the pump rotor 21 on the shaft 20;

4-Fit and bolt the pump stator 23 to the intermediate transom 12, which in the process fits the bearing 22 to the shaft 20—the discharge nozzle 30 and the outboard components of the steering and reversing unit may be pre-assembled with the pump stator 23 prior to installation on the intermediate transom 12; and 5-Install any remaining steering/reversing unit components;

6-Install the fairings.

Most maintenance on the pump and steering/reversing unit can be performed from outside the hull by partial disassembly of the apparatus without drydocking the vessel. Ordinarily, the forward pump housing part 19 can be left in place, thus leaving a watertight enclosure composed of the intake conduit 17 and the forward pump housing part 19 that is isolated from the inside of the hull. (Some or all of the bolts that fasten the forward housing part 19 to the intermediate transom may be exclusive to the forward housing part and separate from the bolts that join the pump stator to the intermediate transom.) If necessary, the shaft 20 can be uncoupled from the prime mover and the shaft and rotor moved aft partially while the shaft 20 remains within the packing.

The first embodiment of a steering/reversing unit, which is shown in FIGS. 9 to 30, has most, but not all, of the features of the steering/reversing unit of the vessel shown in FIGS. 1 to 8 and is suitable in many applications of a waterjet propulsion system according to the present invention. The second embodiment, which is shown in FIGS. 1 to 8 and 31 to 36, is described below.

Referring to FIGS. 9 to 12, the discharge nozzle 30 has a body 34 that converges smoothly toward an outlet opening 36 at the aft end. A steering nozzle 50 is pivotally mounted on upper and lower bosses 38 and 40 of the discharge nozzle 30 for pivotal movement about an axis that lies in a vertical plane that includes the axis of the discharge nozzle 30. As mentioned above the nozzle discharge axis may to advantage be slightly inclined downwardly to aft. The forward portion of the steering nozzle 50 has an internal surface 56 that is spherical, with its center point lying at the intersection of the pivot axis of the steering nozzle and the axis of the discharge nozzle. The surface 56 mates in close clearance with an external complementary surface on the aft end of the discharge nozzle 30. The mating spherical surfaces allow the steering nozzle to pivot from side to side about the pivot axis of the steering nozzle while preventing significant leakage at the interface between the discharge nozzle and the steering nozzle. The body of the steering nozzle 50 is circular-cylindrical and has a upper aft edge portion 50*ur* that lies in a plane perpendicular to the discharge nozzle axis and a lower rear edge portion 501*r* that lies in a plane oblique to the discharge nozzle axis and that is bounded by a flange portion 50*f* that is coplanar with the lower rear edge portion 501*r*.

Figure 12:
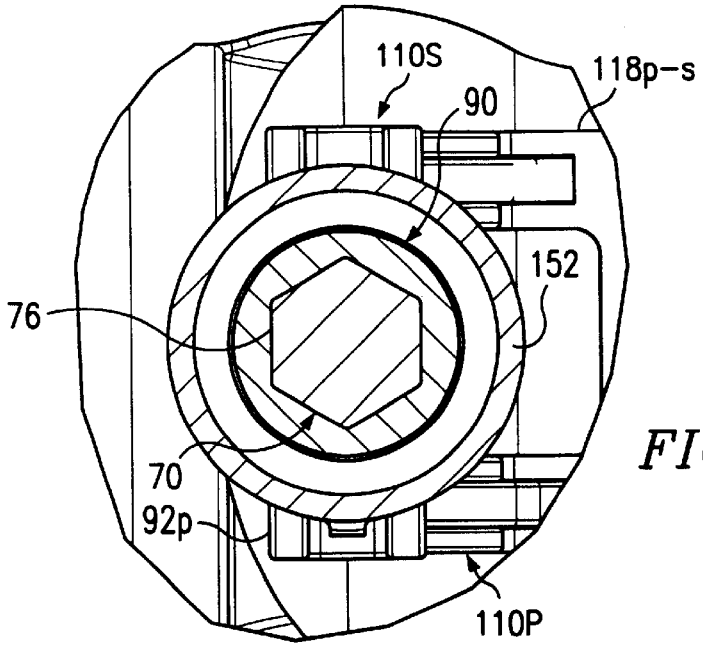
FIG. 12 is a schematic top cross-sectional view, taken along the lines 12—12 of FIG. 10.

A two-part steering shaft 70 extends upwardly coaxially with the pivot axis of the steering nozzle 50. The lower end portion 721 of a lower steering shaft part 72 serves as a pivot pin for the upper pivot mounting of the steering nozzle on the discharge nozzle and is attached to the steering nozzle by bolting a flange 74 to a boss 58 on the steering nozzle. A portion of the upper end of the lower shaft part 72 is received telescopically in the lower end portion of a tubular reversing shaft 90 (described below). The lower portion of an upper steering shaft part 76 is received telescopically in an upper portion of the reversing shaft 90. The outer surfaces of both steering shaft parts 72 and 76 are configured to prevent rotation of the steering shaft parts relative to the reversing shaft about the steering shaft axis while permitting the steering shaft to translate axially relative to the steering shaft. In the embodiment of FIGS. 9 to 30, as shown in FIG. 12, the steering shaft parts 72 and 76 are of hexagonal cross-section and mate in sliding relationship with complementary internal surfaces of hexagonal shape in cross-section of the reversing shaft 90. Other arrangements for coupling the steering shaft parts 72 and 76 to the reversing shaft 90 for conjoint rotation while allowing the reversing shaft to translate axially relative to the steering shaft parts include a sliding key, a sliding spline, a sliding square, and the like.

The two-part steering shaft in conjunction with a transverse wall 90*a* (FIG. 11) within the reversing shaft 90 between the two steering shaft parts 72 and 76 makes it unecessary to provide a seat between the lower steering shaft part 72 and the lower portion of the reversing shaft—the wall 90*a* keeps water from leaking through the interface between the steering shaft and the reversing shaft. That feature simplifies the structure and eliminates a component (a seal) that would be subject to failure and require relatively frequent maintenance.

A reversing deflector 100 having a body 102 of generally cup-like shape is mounted on the aft portion of the steering nozzle 50 for pivotal movement about a horizontal axis by reception of a pair of arm portions 104 in bifurcated mounting bosses 60 affixed to the steering nozzle and pivot pins 106 received in holes in the arm portions 104 and the bosses 60. The pivot axis of the reversing deflector 100 is located near the aft end of the steering nozzle 50 and above the center axis of the steering nozzle.

The reversing deflector 100 is mechanically linked to the reversing shaft 90 by a pair of mechanical linkages 110P and 110S that are located and constructed symmetrically with respect to the steering shaft axis. Each linkage 110P and 110S consists of a Scott-Rouselle mechanism coupled to the reversing shaft 90 and having a pivot output and a reversed crank-slider mechanism coupled to the reversing deflector 100 and a pivot input coupled to the pivot output of the Scott-Rouselle mechanism. The port Scott-Rouselle mechanism consists of the following components:

A link 112*p* that is pivotally coupled by a pivot pin 114*p* at its upper end to a fixed pivot mounting arm 92*p* on the reversing shaft 90 and is pivotally coupled at its lower output end by an input pivot pin 116*p* to a link 118*p-s* of the reversed crank-slider mechanism (the link 118*p-s* is a single Y-shaped member shared by the port and starboard linkages); and A pair of links 120*p*, one on each side of the link 112*p*, each of which is pivotally coupled by a pivot pin 122*p* to a fixed mounting arm 124*p* on the steering nozzle 50 and is pivotally coupled at its upper end by a pivot pin 126*p* to the link 112*p*.

The port reversed crank-slider mechanism consists of:

The link 118*p-s*; and

The rigid mechanical coupling between the port mounting boss 60—by the arm 104 and the reversing deflector body 102—and an arm 128*p* affixed to the steering deflector 100 and coupled by a pivot pin 130*p* to the link 118*p-s*.

The steering shaft 70 and the reversing shaft 90 are driven conjointly in rotation about the steering pivot axis by a suitable rotary drive apparatus 140, various types of which can be used, as mentioned above. The embodiment has a vane-type hydraulic rotary actuator as the rotary drive apparatus 140. When rotated, the output of the rotary drive 140 rotates the upper shaft part 76, which transmits rotational torque to the reversing shaft 90 through the sliding hex coupling (see FIG. 4). The reversing shaft transmits torque through the hex coupling to the lower steering shaft part 72, which by virtue of the affixation of the flange portion 74 of the lower steering shaft part 72 to the steering nozzle 50 and affixation of the reversing deflector by the pivot couplings 60, 106 to the steering nozzle rotates both the steering nozzle and the reversing deflector about the steering axis (more accurately, the common axis of the steering shaft 70 and the reversing shaft 90). Rotation of the steering nozzle deflects the jet so that it exits from the steering and reversing apparatus with a lateral thrust component. FIGS. 18 to 22 show the apparatus rotated to port, thus to turn the vessel to port.

A suitable axial drive device 150, examples of which are referred to above, is coupled between the upper steering shaft part 76 and the reversing shaft 90 and when actuated translates the reversing shaft up or down relative to the steering shaft. In the embodiment, the axial drive device is a double-acting piston/cylinder, which consists of an annular piston portion 92 at the upper end of the reversing shaft 90 and a cylinder 152, which is bolted at its upper end to a flange 76*f* on the upper steering shaft part 76 and is sealed in sliding relation at its lower end to the reversing shaft. Hydraulic fluid is supplied to or discharged from the respective working chambers of the piston/cylinder axial drive 150 through cylinder ports 154 and 156.

In an upper position of the reversing shaft 90 (see FIGS. 9 to 11 and 13 to 17), the reversing deflector is retained in an inactive position above the water jet that emerges from the steering nozzle, thus enabling ahead propulsion of the vessel. Axial translation downwardly of the reversing shaft 90 from the position shown in FIGS. 9 to 11 and 13 to 17 pivots the reversing deflector 100 downwardly so that the water jet exiting the steering nozzle is intercepted and deflected so that has a forward component, thus enabling reverse propulsion of the vessel. FIGS. 23 to 30 show the steering and reversing apparatus in the reverse propulsion mode. In the reverse propulsion mode with the steering deflector in the active downward position, the steering nozzle can be rotated by the rotary drive 140, thus to provide reverse steering.

As previously mentioned, steering and reversing apparatus embodying the present invention is mounted in a portion of a vessel hull above the aft bottom portion 10*a* that overlies the outlet of the discharge nozzle, thereby permitting the rotary drive device 140 for the steering shaft 70 and the axial drive 150 for the reversing shaft 90 to be located within the hull above the aft bottom section 10*a*. In the fully submerged installations according to the present invention, the portion of the reversing shaft below the cylinder 154 and above the pivot mounting arms 92*p* passes through a suitable seal installed in an opening in the hull (e.g., in the deck 16*d*).

The second embodiment of a steering/reversing unit, which is shown in FIGS. 31 to 37, is similar in most respects to the first embodiment. Therefore, the same reference numerals applied to FIGS. 31 to 37 are the same as those applied to FIGS. 31 to 37 but increased by 200, and the above description is fully applicable to the second embodiment.

The second embodiment has an upper reversing deflector 300 that is pivotally mounted by pivot mountings 306 near its forward end on the steering nozzle 250 and is accommodated in an opening 307 in the upper wall of the steering nozzle. A lower reversing deflector 400 is pivotally mounted on the steering nozzle 250 by pivot mountings 402 and is accommodated in an opening in the lower wall of the steering nozzle. In the inactive positions, as shown in FIGS. 31 to 37, the reversing deflectors 300 and 400 allow a water jet emerging from the discharge nozzle to pass through the steering nozzle 250 to aft for forward propulsion.

The upper reversing deflector 300 is coupled by links 406 to the lower reversing deflector 400 so that when the actuating linkages 310*p-s* and 318*p-s* associated with the reversing shaft 290 pivot the upper reversing deflector 250 aftward and downward to the active position, the lower reversing deflector 400 is pivoted by the links 406 aftward and upward about its pivot mounting 402 in coordination with the pivotal movement of the upper reversing deflector. In the active positions, the upper and lower reversing deflectors 300 and 400 abut each other at their aftward (in the inactive positions shown) edges, thus forming an effectively single deflecting surface, which redirects the water jet. Inasmuch as the reversing deflectors are both mounted on the steering nozzle, reverse propulsions by the water jet can be accompanied by lateral propulsions.

It is well-known that various combinations of forward and reverse propulsion forces with lateral components in twin propulsion systems permit a wide range of maneuvers of marine vessels. In that regard, a propulsion system according to the present invention can be installed close to the bow of a vessel to provide additional forward propulsion, enhanced steering capability, and enhanced maneuverability, such as very rapid rotation about the z-axis.

FIGS. 31 to 37 also show lateral support ribs 410 on the steering nozzle 250 for mounting of the second fairing unit 26 and bottom support ribs 412 on the lower reversing deflector 400 the third fairing unit 27, which fills the bottom opening in the second fairing unit. In the aftward propulsion mode, the third fairing unit 27 pivots down and to aft, leaving an opening in bottom of the second fairing unit 26 for the deflected water jet to flow forwardly.

The steering/reversing unit of FIGS. 9 to 30 is useful for vessels that are not subject to rigorous maneuvers, such as switching from forward to reverse propulsion while the vessel is travelling at a high speed, that result in large transient vertical forces on the reversing deflector that are transmitted to the vessel and also subject the reversing deflector mountings and actuating linkages to high loads.

The dual reversing deflectors of the second embodiment, on the other hand, produce vertical force components at the time of movement to the active positions that largely or completely offset each other, thus minimizing application of a vertical force to the vessel. Also, the area of each reversing deflector in the embodiment of FIGS. 31 to 37 can be smaller than that of a single reversing deflector providing the same effect, thus reducing the loads on each deflector and its mounts and actuating linkages by as much as one-half, all other things being equal.

What is claimed is:

1. A surface vessel comprising a hull having an aft portion that includes a stern transom, an intermediate transom located below and forwardly of the stern transom and below the waterline of the hull, and an aft bottom section that extends from the lower edge of the stern transom forwardly to a location generally above and proximate to the intermediate transom;

a water intake conduit having an inlet opening in the hull forward of the intermediate transom and an outlet opening within the hull forward of the intermediate transom;

a waterjet propulsion pump having a housing mounted in an opening in the intermediate transom and including a forward part connected forward of the intermediate transom to the outlet opening of the intake conduit and including an aft part extending aft from the intermediate transom, a rotor received in the forward part, a stator received in the aft part, and a discharge nozzle aft of the stator;

a steering nozzle pivotally mounted on the discharge nozzle to intercept a water jet discharged from the pump and coupled to a lower end of a steering shaft that is rotatable about a steering axis and extends upwardly from the steering nozzle through an opening in the aft bottom section and has an upper end portion located within the hull; and a steering actuator located within the vessel hull and coupled to the steering shaft for rotating the steering shaft about the steering axis; and wherein at least an aft portion of the intake conduit and the forward part of the pump housing are received in a downwardly extending protuberance forming a portion of the hull structure and having an aft end joined to the intermediate transom, the protuberance being hydrodynamically shaped and faired to portions of the bottom of the hull forward and abreast of the protuberance.

2. The vessel according to claim 1, wherein the pump is a mixed flow pump or an axial flow pump, the pump, the discharge nozzle and the steering nozzle have a common axis that slopes downwardly and rearwardly at an acute angle relative to the base line of the hull, and the steering pivot axis is perpendicular to the common axis.

3. The vessel according to claim 1 wherein an upper reversing deflector is mounted on the steering nozzle for pivotal movement about a reversing pivot axis between an inactive position above and substantially clear of a water jet discharged from the steering nozzle and an operative position in which the water jet impinges on a surface of the reversing deflector that is configured to reverse the direction of the water jet to a direction having a forward vector, and the reversing pivot axis is perpendicular to a vertical plane and spaced apart from the steering shaft, a hollow reversing shaft is received telescopically over a portion of the steering shaft and is translatable axially relative to the steering shaft, and a mechanical linkage is coupled between the reversing shaft and the reversing deflector so as to pivot the reversing deflector between the inactive position and the operative position in response to axial translation of the reversing shaft.

4. The vessel according to claim 3 wherein the steering shaft has an upper steering shaft part having a lower end portion received telescopically within an upper portion of the reversing shaft and a lower shaft part having an upper portion received telescopically in a lower portion of the reversing shaft.

5. The vessel according to claim 3 wherein the linkage includes a Scott-Rouselle mechanism coupled to the reversing shaft and having a pivot output and a reversed crank-slider mechanism coupled to the reversing deflector and a pivot input coupled to the pivot output of the Scott-Rouselle mechanism.

6. The vessel according to claim 3 wherein the reversing actuator is an annular piston/cylinder affixed within the hull and having an annular piston coupled to the steering shaft.

7. The vessel according to claim 3 wherein the mechanical linkage includes a pair of Scott-Rouselle mechanisms coupled to the reversing shaft, each having a pivot output, and a pair of reversed crank-slider mechanisms coupled to the reversing deflector, each reversed crank-slider mechanism a pivot input coupled to the pivot output of one of the Scott-Rouselle mechanisms, each pair of mechanisms being symmetrically located and configured with respect to the vertical plane.

8. The vessel according to claim 3 wherein a lower reversing deflector is mounted for pivotal movement on the steering nozzle for pivotal movement about an axis perpendicular to a vertical plane and spaced apart from the steering shaft and for movement between an inactive, position below and substantially clear of a water jet discharged from the steering nozzle and an operative position in which a portion of the water jet impinges on a surface of the lower reversing deflector that is configured to reverse the direction of the water jet to a direction having a forward vector, and a mechanical linkage is coupled between the upper reversing deflector and the lower steering deflector so that movements of the upper and lower reversing deflectors between the inactive and active positions are coordinated.

9. The vessel according to claim 1 wherein a first fairing unit extends aft from the secondary transom to a location proximately forward of a transverse plane that includes the steering axis, downwardly from the aft bottom section and under the aft part of the pump housing, the first fairing unit being fair to the lines of the protuberance.

10. The vessel according to claim 9 wherein a second fairing unit that is fair to the lines of the first fairing unit is mounted on the steering nozzle for rotation therewith and extends aft from the aft end of the first fairing unit to a location proximate to a transverse plane parallel to the steering shaft and including an aft extremity of the reversing deflector and downwardly from the aft bottom section and has an opening on its underside that allows the waterjet deflected by the reversing deflector to pass the second fairing and under the aft part of the pump housing.

* * * * *

UNITED STATES PATENT AND TRADEMARK OFFICE

CERTIFICATE OF CORRECTION

PATENT NO. : 6,238,257 B1
DATED : May 29, 2001
INVENTOR(S) : Platzer et al.

It is certified that error appears in the above-identified patent and that said Letters Patent is hereby corrected as shown below:

Title page,
Item [56], References Cited, insert:

-- U.S. PATENT DOCUMENTS

| | | |
|---|---|---|
| 340,237 | 4/1886 | Nagel et al. |
| 3,064,420 | 11/1962 | Goehler |
| 3,089,454 | 5/1963 | Chronic |
| 3,138,922 | 6/1964 | Englehart et al. |
| 3,143,857 | 8/1964 | Eaton |
| 3,207,116 | 9/1965 | France |
| 3,266,733 | 8/1966 | Goehler |
| 3,241,770 | 3/1966 | Reynolds et al. |
| 3,756,185 | 9/1973 | Breslin |
| 3,776,173 | 12/1973 | Horwitz |
| 3,807,346 | 4/1974 | Delfeld |
| 3,901,176 | 8/1975 | Copp et al. |
| 4,026,235 | 5/1977 | Woodfill |
| 4,315,749 | 2/1982 | Baker et al. |
| 4,895,093 | 1/1990 | Dalsbö |
| 4,992,065 | 2/1991 | Törneman et al. |
| 5,045,002 | 9/1991 | Törneman et al. |
| 5,240,443 | 8/1993 | Futaki |
| 5,376,028 | 12/1994 | Koyanagi |
| 5,401,197 | 3/1995 | Kobayashi |
| 5,421,753 | 6/1995 | Roos |
| 5,505,640 | 4/1996 | Angulo |
| 5,520,133 | 5/1996 | Wiegert |
| 5,536,187 | 7/1996 | Nanami |
| 5,752,864 | 5/1998 | Jones et al. |
| 6,071,156 | 6/2000 | Platzer et al. |
| 6,152,792 | 11/2000 | Lanni et al. |

FOREIGN PATENT DOCUMENTS

| | | |
|---|---|---|
| 39 36 598 | A16/1991 | Germany |

UNITED STATES PATENT AND TRADEMARK OFFICE

CERTIFICATE OF CORRECTION

PATENT NO. : 6,238,257 B1
DATED : May 29, 2001
INVENTOR(S) : Platzer et al.

It is certified that error appears in the above-identified patent and that said Letters Patent is hereby corrected as shown below:

OTHER DOCUMENTS,
Chen, Benjamin Y-H, "Integrated Ducted Propulsor Concept," SNAME Symposium at Virginia Beach, Virginia, September 17-18, 1991, pp. 19-1 to 19-10.

Dia, Charles, "Development of a Vertical Motor Propulsor," SNAME Symposium at Virginia Beach, Virginia, September 23-24, 1997, pp. 1 to 19. --

Column 2,
Line 52, "athwart ship" should read -- athwartship --

Column 5,
Line 54, "view" (second occurrence) should be deleted

Column 6,
Line 5, "rear" should read -- a rear --

Column 7,
Line 45, "associated" should read -- associated with --

Column 9,
Line 23, "unecessary" should read -- unnecessary --

Column 12,
Line 22, "at least" should read -- ¶at least --

UNITED STATES PATENT AND TRADEMARK OFFICE

CERTIFICATE OF CORRECTION

PATENT NO. : 6,238,257 B1
DATED : May 29, 2001
INVENTOR(S) : Platzer et al.

It is certified that error appears in the above-identified patent and that said Letters Patent is hereby corrected as shown below:

Column 13,
Line 14, "inactive," should read -- inactive --

Signed and Sealed this

Twenty-fourth Day of December, 2002

JAMES E. ROGAN
*Director of the United States Patent and Trademark Office*